US006288480B1

(12) United States Patent
Takano et al.

(10) Patent No.: US 6,288,480 B1
(45) Date of Patent: Sep. 11, 2001

(54) COLOR CATHODE RAY TUBE

(75) Inventors: Naohisa Takano; Masahiro Yokota, both of Fukaya (JP)

(73) Assignee: Kabushiki Kaisha Toshiba, Kanagawa-Ken (JP)

( * ) Notice: Subject to any disclaimer, the term of this patent is extended or adjusted under 35 U.S.C. 154(b) by 0 days.

(21) Appl. No.: 09/308,169

(22) PCT Filed: Sep. 9, 1998

(86) PCT No.: PCT/JP98/04048

§ 371 Date: May 10, 1999

§ 102(e) Date: May 10, 1999

(87) PCT Pub. No.: WO99/13487

PCT Pub. Date: Mar. 18, 1999

(30) Foreign Application Priority Data

Sep. 10, 1997 (JP) ..... 9-245576

(51) Int. Cl.[7] ..... H01J 29/02; H01J 29/07
(52) U.S. Cl. ..... 313/407; 313/404; 313/402
(58) Field of Search ..... 313/402–408

(56) References Cited

U.S. PATENT DOCUMENTS

| | | | | |
|---|---|---|---|---|
| 3,803,436 | | 4/1974 | Morrell | 313/85 S |
| 4,315,189 | * | 2/1982 | Goto et al. | 313/405 |
| 4,491,763 | * | 1/1985 | Fujinuma et al. | 313/405 |
| 5,717,280 | * | 2/1998 | Lee | 313/404 |
| 5,880,556 | * | 3/1999 | Makimoto et al. | 313/405 |
| 5,914,557 | * | 6/1999 | Tai et al. | 313/407 |
| 5,982,084 | * | 11/1999 | Etou | 313/406 |
| 6,144,148 | * | 11/2000 | Tong et al. | 313/407 |

FOREIGN PATENT DOCUMENTS

| | | |
|---|---|---|
| 42-11012 | 6/1967 | (JP) . |
| 44-3546 | 2/1969 | (JP) . |
| 45-32500 | 10/1970 | (JP) . |
| 49-98175 | 9/1974 | (JP) . |
| 55-79058 | 5/1980 | (JP) . |
| 1-267930 | 10/1989 | (JP) . |
| 09-231913 | 9/1997 | (JP) . |
| 09-237585 | 9/1997 | (JP) . |

* cited by examiner

*Primary Examiner*—Michael H. Day
*Assistant Examiner*—Matthew J. Gerilce
(74) *Attorney, Agent, or Firm*—Pillsbury Winthrop LLP

(57) ABSTRACT

A holder 30 supporting a mask frame 13 is formed by bending an elongated, substantially rectangular metal plate in opposite directions along first and second bending lines 33*a* and 33*b*, such that the holder has an engagement portion 35 engaged with a corresponding stud pin, a fixed portion 34, and a slope portion 36 extending and inclined between the engagement portion and the fixed portion. When the mask frame has thermally expanded, the holder moves the mask frame toward a phosphor screen along the center axis of a face panel. The fixed portion 34 has a projection 40 projecting from the vicinity of an acute-angle portion 50 which is defined by a side edge of the fixed portion and the first bending line. The fixed portion is fixed to the mask frame in the vicinity of the first bending line by welding at least a part of the projection to the mask frame.

9 Claims, 4 Drawing Sheets

COLOR CATHODE RAY TUBE

This application is the national phase of international application PCT/JP98/04048 filed Sep. 9, 1998 which designated the U.S.

TECHNICAL FIELD

This invention relates to a color cathode-ray tube, and more particularly, to a color cathode-ray tube having a shadow mask supported by elastic support members which are provided for compensating deviation of beam landing due to thermal expansion of the shadow mask or a face panel.

BACKGROUND ART

In general, a color cathode-ray tube is provided with an envelope that includes a rectangular face panel having side wall sections on a peripheral edge portion of an effective section thereof, and a funnel coupled to the side wall sections of the panel. A phosphor screen comprising three color phosphor layers which are able to emit blue, green and red light is formed on the inner surface of the effective section of the face panel. In the envelope, a substantially rectangular shadow mask is opposed to the inside of the face panel. An electron gun for emitting three electron beams is disposed in the neck of the funnel.

The electron beams emitted from the electron gun are deflected by a deflecting device mounted on the outer surface of the funnel, and are used to horizontally and vertically scan the phosphor screen through the shadow mask, thereby displaying a color image.

The shadow mask serves to sort out the three electron beams from the electron gun and then correctly land them onto the three color phosphor layers, in order to obtain desired colors. The shadow mask has a substantially rectangular shadow mask body with multiple electron beam passage apertures, and a substantially rectangular mask frame attached to the periphery of the shadow mask body. At least three side walls of the mask frame are supported on the face panel side walls by means of elastic holders. Each holder has an end portion fixed to the mask frame, and the other end portion engaged with a stud pin which is provided on the inner surface of a corresponding side wall of the face panel.

In color cathode-ray tubes having a shadow mask, only 30% or less of the electron beams emitted from the electron gun pass through the electron beam passage apertures of the shadow mask body and reach the phosphor screen, whereas about 70% of the electron beams strike upon the shadow mask body. As a result of the striking of the electron beams, the shadow mask is heated and thermally expanded. When, in particular, displaying an image of a high luminance, the relative positions of the electron beam passage apertures to the phosphor screen change due to the thermal expansion of the shadow mask body and the mask frame, thereby disabling the electron beams, having their spots shaped by the shadow mask body, to strike upon or land on respective phosphor layers. As a result, color purity degradation will occur.

The cause of such color purity degradation during the operation of the color cathode-ray tube is mainly classified into two types, i.e. thermal expansion of the shadow mask body and that of the mask frame.

Color purity degradation due to the thermal expansion of the shadow mask body occurs at the initial time of high luminance image display, and the landing position of each electron beam is displaced from a predetermined position in the radial direction toward the center of the phosphor screen. This displacement is caused by a doming phenomenon, which occurs when the shadow mask body of a small heat-capacity is mainly heated while the mask frame of a large heat-capacity is not greatly heated, and in which phenomenon the shadow mask body expands toward the phosphor screen.

The doming is a phenomenon in which the outward size of the mask frame does not change and the shadow mask body thermally expands and swells upon the phosphor screen, and causes the landing positions of the electron beams to be displaced toward the center of the screen (hereinafter, color purity degradation due to the doming phenomenon will be referred to as a "PD-1").

The PD-1 can be suppressed by making the shadow mask body of a material of a low thermal expansion property to thereby reduce the degree of mask doming due to the thermal expansion of the shadow mask.

Further, the color purity degradation due to thermal expansion of the mask frame (hereinafter referred to a "PD-2") occurs when the landing position of each electron beam is displaced from a predetermined position toward the radially outside of the phosphor screen. This displacement is caused when the outward size of the mask frame increases to thereby relax the doming phenomenon, while a peripheral portion of the shadow mask body is pulled by the mask frame, as a result of heat transmission from the shadow mask body to the mask frame.

A method for correcting color purity degradation due to the thermal expansion of the mask frame is proposed, in which elastic members for supporting the mask frame on the face panel, i.e., holders, have their shape, material, etc. modified appropriately.

Specifically, each of the holders, for example, is formed by bending an elongated metal plate, and comprises a fixed portion fixed to the mask frame, an engagement portion having an engagement hole to be engaged with a corresponding stud pin projecting from the face panel, and a slope portion extending between the fixed portion and the engagement portion. The metal plate is bent along a first bending line located between the fixed portion and the slope portion, and also along a second bending line located between the slope portion and the engagement portion. The first and second bending lines extend at an angle to the direction which is perpendicular to the longitudinal axis of the holder.

Where the mask frame is supported by such holders, when the mask frame thermally expands and compresses the holders, they are elastically deformed in a direction in which their bent portions extend, thereby displacing the mask frame toward the phosphor screen. In accordance with this displacement, the shadow mask body as well moves toward the phosphor screen. As a result, the landing positions of the electron beams are corrected and the color purity degradation is suppressed.

The amount of displacement of the mask frame along the axis of the tube, which determines the correction amount for the PD-2, is determined on the basis of the height of each bent holder, and the angle of the first and second bending lines. To increase the correction amount for the PD-2, it is necessary to reduce the angle of the bending lines with respect to the longitudinal central line of each holder, and to increase the displacement amount of the mask frame along the tube axis.

The displacement amount of the mask frame due to thermal expansion is determined depending upon how firmly the holders are fixed on the mask frame. In other words, to obtain a predetermined displacement amount of the mask frame, it is important to reliably secure the holders to the mask frame.

However, in the above-described holder, the fixed portion has the same width as the slope portion, and therefore the acute-angle portion of the fixed portion, which is defined by side edges of the fixed portion and the first bending line, contacts the mask frame by only a small area. This makes it difficult to secure, in the fixed portion, a sufficient portion necessary for spot welding. As a result, the fixed portion is welded at a portion away from the acute-angle portion, which means that the acute-angle portion of the fixed portion, which is the root of the slop portion, cannot be firmly secured to the mask frame. Similarly, depending upon the shape of the mask frame, the fixed portion of the holder cannot firmly be secured thereto.

Accordingly, the acute-angle portion will separate from the mask frame during elastic deformation of the holder, thereby causing a gap to be defined between the fixed portion and the mask frame. The result is that the displacement of the mask frame along the tube axis is deviated from a desired set value while the mask frame thermally expands, and therefore the PD-2 cannot be corrected satisfactory.

DISCLOSURE OF INVENTION

The present invention has been developed in light of the above and its object is to provide a color cathode-ray tube capable of correcting color purity degradation due to thermal expansion without degrading the elastically supporting property of elastic support members incorporated therein.

To obtain the object, a color cathode-ray tube according to the present invention comprises:

a face panel having a substantially rectangular effective section, four side walls provided on a peripheral edge portion of the effective section, stud pins projecting form inner surfaces of at least three of the side wall sections;

a phosphor screen formed on an inner surface of the effective section of the face panel;

a shadow mask arranged inside the face panel, having a substantially rectangular mask body opposed to the phosphor screen, and also having a substantially rectangular mask frame supporting a peripheral edge portion of the mask body and opposed to the side walls;

a plurality of holders elastically supporting the mask frame on the side walls of the face panel, the holders being adapted to move the mask frame toward the phosphor screen along a center axis of the face panel when the mask frame has thermally expanded toward the side walls of the face panel; and an electron gun for emitting electron beams toward the phosphor screen through the shadow mask, wherein each of the holders is formed by bending an elongate and substantially rectangular metal plate along at least one bending line which inclines to a longitudinal axis of the metal plate, such that each holder has an engagement portion engaged with a corresponding one of the stud pins, and a fixed portion fixed to the mask frame, and the fixed portion has an acute-angle portion which is defined by a longitudinal side edge of the fixed portion and the bending line, and a projection projecting from the acute-angle portion, the fixed portion being fixed to the mask frame in the vicinity of the acute-angle portion by welding at least a part of the projection to the mask frame.

In the color cathode-ray tube constructed as described above, each holder has a projection projecting from a portion close to the acute-angle portion. This projection is used as a welding area of the fixed portion, whereby the portion of the fixed portion which is adjacent to the slope portion can be welded. This means that each holder can be secured to the mask frame so that an end portion of the slope portion will not separate from the mask frame. When the mask frame has thermally expanded and the electron beam landing position has shifted in a radially outward direction of the screen at the time of occurrence of PD-2, the holders are compressed toward the side walls of the face panel, thereby moving the mask frame and the mask body toward the phosphor screen. As a result, the electron beam landing position shifts toward the center of the screen, whereby color purity degradation caused by the thermal expansion of the mask frame is corrected.

BRIEF DESCRIPTION OF DRAWINGS

FIGS. 1 to 8C show a color cathode-ray tube according to an embodiment of the invention, in which:

FIG. 1 is a longitudinal sectional view of the color cathode-ray tube;

FIG. 2 is a front view of a face panel and a shadow mask incorporated in the color cathode-ray tube, taken when viewed from the electron gun side;

FIG. 3 is a perspective view of one of holders which support the shadow mask;

FIG. 4 is a front view of the holder;

FIG. 5 is a plan view of the holder;

FIGS. 8A to 8C are a sectional view, a side view and another sectional view, respectively, illustrating the movement of the holder assumed when the mask frame has thermally expanded.

BEST MODE OF CARRYING OUT THE INVENTION

Color cathode-ray tubes according to the embodiments of the invention will be described in detail with reference to the accompanying drawings.

Figure 1:
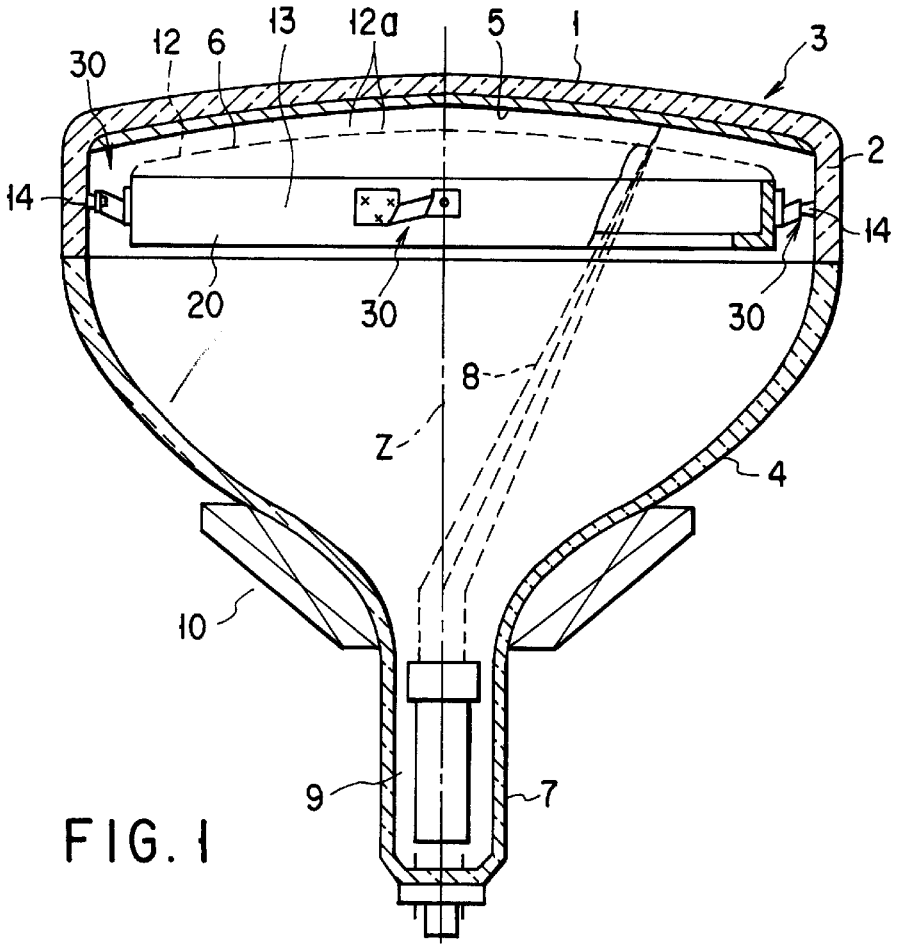
Figure 2:
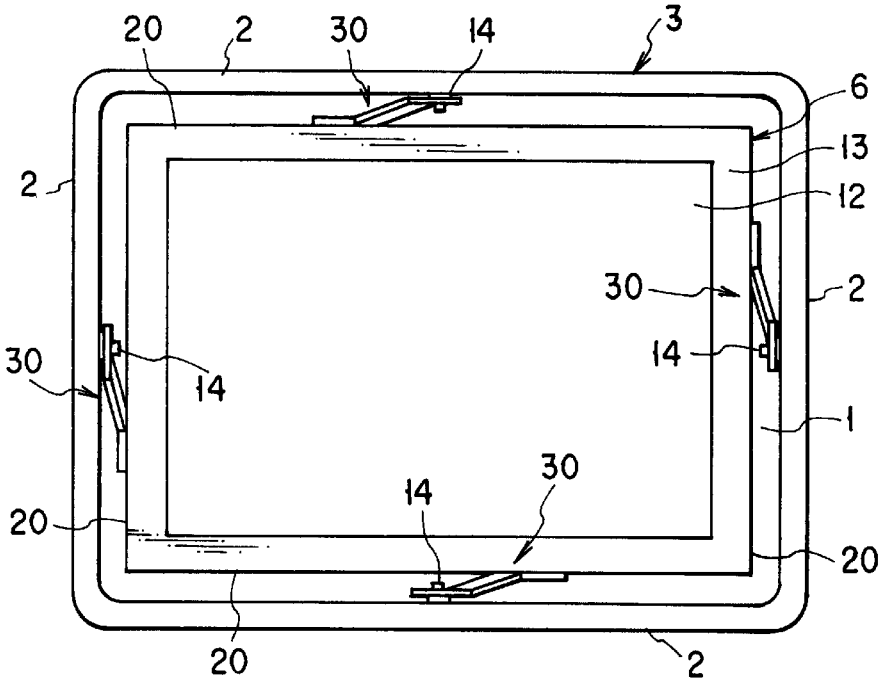

As is shown in FIGS. 1 and 2, a color cathode-ray tube is provided with a vacuum envelope, which comprises a substantially rectangular glass panel 3 and a funnel 4. The panel 3 has a substantially rectangular effective section 1, and four side wall sections 2 placed on a peripheral edge portion of the effective section 1. The funnel 4 is connected to the side wall sections 2. A tapered stud pin 14 protrudes inward from a center portion of the inner surface of each of the side wall sections 2.

A phosphor screen 5 formed of three-color phosphor layers, which are able to emit blue, green and red light, is provided on the inner surface of the effective section 1. A substantially rectangular shadow mask 6 is arranged inside the panel 3, opposed to the phosphor screen 5.

In the neck 7 of the funnel 4 is arranged an electron gun 9 that emits three electron beams 8. The three electron beams 8 emitted from the electron gun 9 are deflected by a deflecting device 11 which is mounted on the outside of the funnel 4, and scan the phosphor screen 5 horizontally and vertically through the shadow mask 6. Thus, a color image is displayed on the phosphor screen 5.

The shadow mask 6 having a color selecting function includes a substantially rectangular mask body 12 provided with multiple electron beam passage apertures 12*a*, and a rectangular mask frame 13 supporting the peripheral edge of the mask body. The mask body 12 is made of Invar, while the mask frame 13 is made of iron.

The mask frame 13 has four walls 20, which extend parallel to the axis of the panel 3, i.e. the tube axis Z of the color cathode-ray tube, and are opposed to the side wall sections 2 of the panel 3 with a predetermined space therebetween. Each wall 20 has an L-shaped cross section. The walls 20 of the mask body 12 are supported on the panel 3 by means of holders 30 serving as elastic support members, so that the mask body 12 opposes to the phosphor screen 5 with a predetermined distance.

Figure 3:
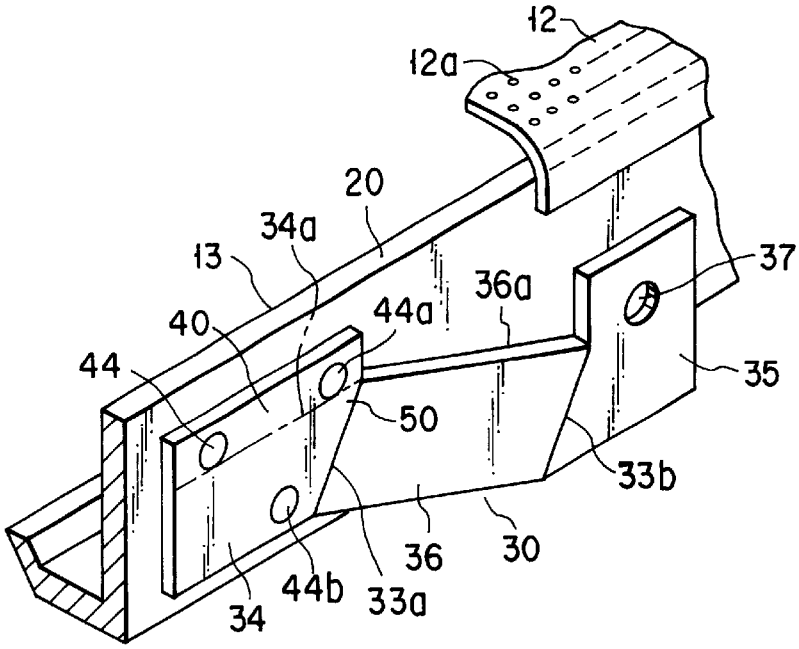
Figure 4:
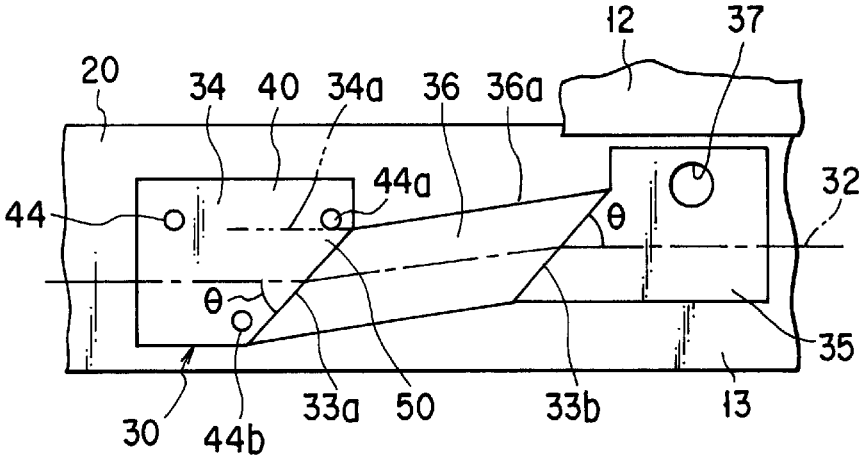
Figure 5:
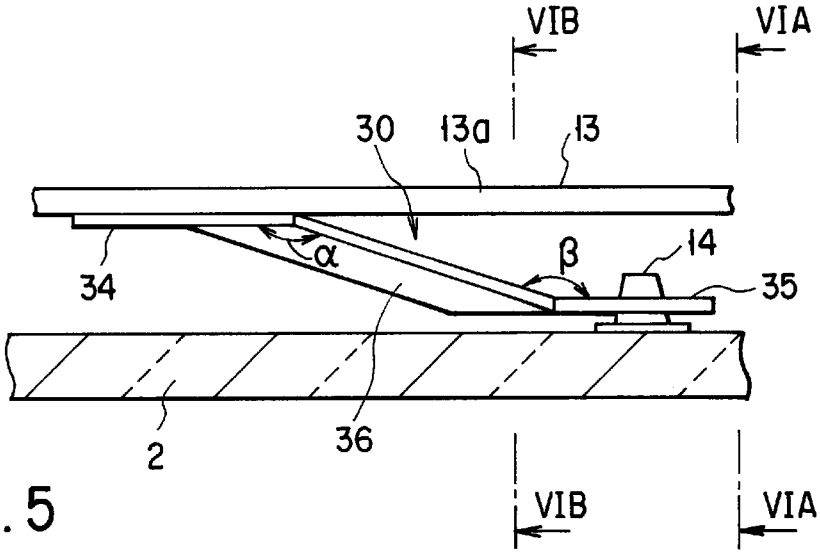
Figure 6A:
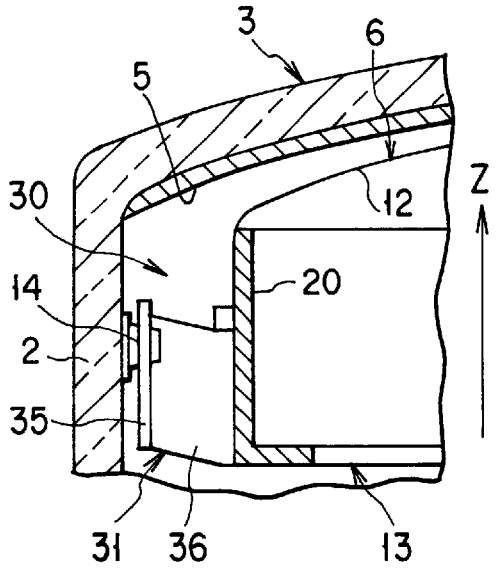
FIG. 6A is a sectional view taken along lines VIA—VIA in FIG. 5.
Figure 6B:
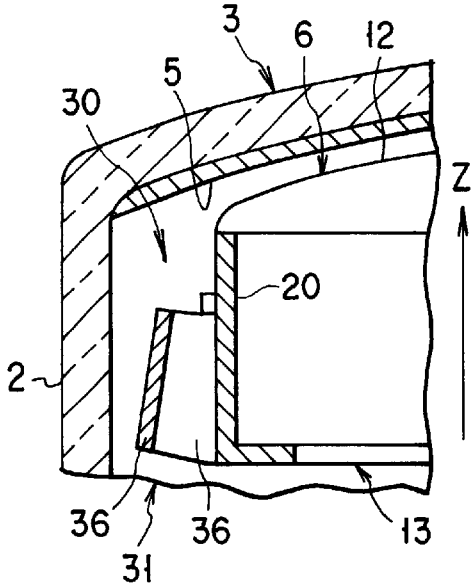
FIG. 6B is a sectional view taken along lines VIB—VIB in FIG. 5.

As is shown in FIGS. 3 to 5, each holder 30 is formed by bending an elongated rectangular, metal plate. Specifically, each holder 30 is bent at two portions along two parallel lines 33*a* and 33*b* (first and second bending lines) that are inclined at an angle $\theta$ ($\theta<90°$) to its longitudinal center axis 32. The angle $\theta$ is set at, for example, 45°. The bending directions along the first and second bending lines 33*a* and 33*b* are opposite to each other, and the bending angles $\alpha$ and $\beta$ are greater than 90°.

As a result of the bending at the two portions, each holder 30 has a fixed portion 34 located at its longitudinal one end, an engagement portion 35 located at the other longitudinal end, and a slope portion 36 extending between the fixed portion 34 and the engagement portion 35, i.e. between the first and second bending lines 33*a* and 33*b*. The engagement portion 35 has a substantially circular through hole 37.

The fixed portion 34 is fixed to a corresponding wall 20 of the mask frame 13, while the engagement portion 35 is supported by the face panel 2 with a corresponding stud pin 14 being inserted into the through hole 37. Each holder 30 is made of a material, for example, stainless steel SUS420, which has a lower thermal expansion coefficient than that of the mask frame 13.

Further, the fixed portion 34 of each holder 30 is formed wider than the slope portion 36. Specifically, the fixed portion 34 has a projection 40 projecting over the side edge 36*a* of the slope portion 36 from a side edge 34*a* which is included in longitudinal side edges extending parallel to the center axis 32, and which extends at an acute angle to the first bending line 33*a*. This projection 40 projects at right angles to the side edge 36*a*.

Each fixed portion 34 is fixed to a corresponding wall 20 of the mask frame 13, with a plurality of points thereof, e.g. three points, spot-welded to the wall 20. Two weld spots 44*a* and 44*b* of the three weld spots 44 are located adjacent to the opposite ends of the first bending line 33*a*. Especially, the weld spot 44*a* is located at the projection 40 of the fixed portion 34, and sufficiently adjacent to the end of the first bending line 33*a* which is at the projection 40 side.

As is shown in FIGS. 4 to 6B, each holder 30 constructed as above is fixed to the mask frame such that the center axis 32 of the fixed portion 34 is parallel to the longitudinal axis of the corresponding wall 20 of the mask frame 13. Further, each holder 30 is supported by the face panel 3, with the corresponding stud pin 14 on the corresponding wall section 2 of the face panel 3 being inserted through the through hole 37 of the engagement portion 35. In this state, the fixed portion 34 and the engagement portion 35 of each holder 30 extend substantially parallel to each other, and are opposed substantially parallel to the corresponding wall 20 of the mask frame 13 and the corresponding side wall section 2 of the face panel 3.

Since each holder 30 is bent along the pair of bending lines 33*a* and 33*b* which incline at the angle $\theta$ to the center axis 32, in particular, incline upward to the right in FIG. 4, the engagement portion 35 of each holder is engaged with the stud pin 14 while being located at a position closer to the phosphor screen 5 than the fixed portion 35 with respect to the direction of the tube axis Z. Further, the slope portion 36 inclines to the tube axis Z, and also to two lines which are perpendicular to each other and to the tube axis Z.

Each stud pin 14 is provided on a longitudinal central portion of a corresponding side wall section 2 of the panel 3. Accordingly, the mask holders 30 are fixed to the mask frame 13 such that the through holes 37 formed in the engagement portions 35 are opposed to longitudinal central portions of the three wall sections 20 of the mask frame 13, as is shown in FIG. 2.

A description will now be given of the operation of the color cathode-ray tube constructed as above, using the holders 30, to correct the degradation of color purity due to the thermal expansion of the mask frame.

Figure 7A:
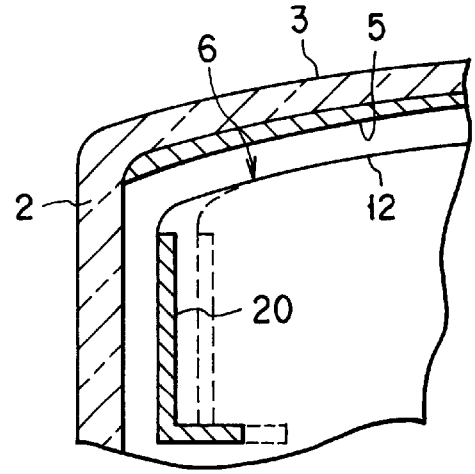
FIG. 7A is a sectional view illustrating a state in which a mask frame thermally expands.

While the color cathode-ray tube is operated, the mask body 12 is heated as a result of the striking of electron beams thereon. The heat of the mask body is transmitted to the mask frame 13, whereby the mask frame 13 thermally expands, and each wall 20 is displaced from a position indicated by the broken line toward a corresponding side wall section 2 of the panel 3, as is shown in FIG. 7A. At this time, the mask body 12 is pulled by the mask frame 13 and displaced in the same direction.

Figure 7B:
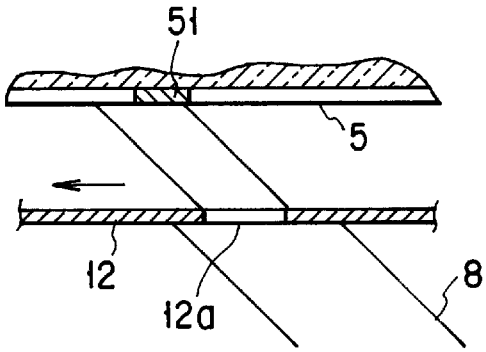
FIG. 7B is a schematic view illustrating a state in which the landing position of an electron beam is displaced as a result of thermal expansion of the mask frame.

Further at this time, the electron beam passage apertures 12*a* of the mask body 12 move radially outward relative to the phosphor screen 5 as shown in FIG. 7B, with the result that each electron beam 8 having passed through a corresponding beam passage aperture 12*a* lands on that portion of the phosphor screen 5 which is radially outwardly deviated from a target phosphor layer 51. This is the cause of the degradation of color purity.

Figure 7C:
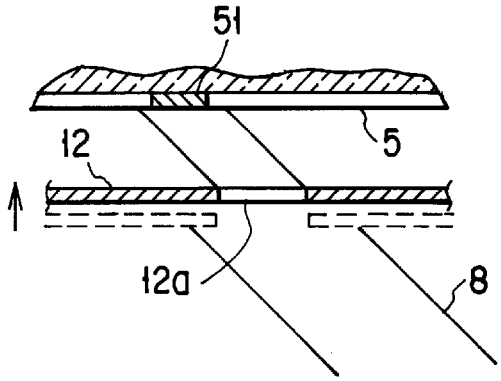
FIG. 7C is a schematic view illustrating the movement of the shadow mask necessary to correct the displacement of the landing position of the electron beam.

To avoid the above, each holder 30 moves the mask body 12 toward the phosphor screen 5 from a normal position indicated by the broken line to a correcting position indicated by the solid line in FIG. 7C, thereby adjusting the landing position of the electron beam 8 to the target phosphor layer 51.

Figure 8A:
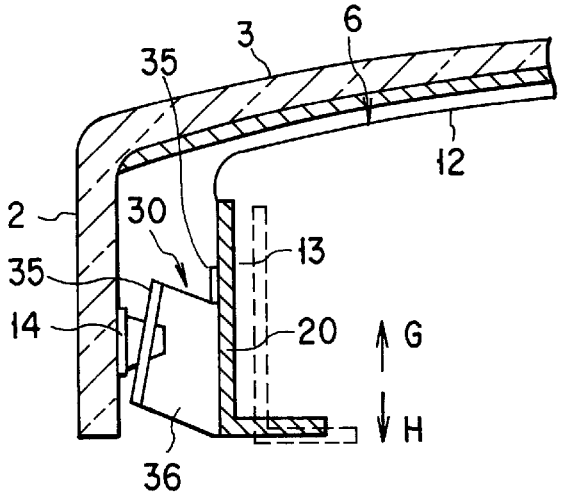

More specifically, when the mask frame 13 has thermally expanded during the operation of the color cathode-ray tube, the space between the walls 20 of the mask frame 13 and the wall sections 2 of the panel 3 is narrowed, and the mask holders 30 located in the space are compressed as shown in FIG. 8A. As a result, each holder 30 deforms such that the angle $\alpha$ between the fixed portion 34 and the slope portion 36 and the angle β between the engagement portion 35 and the slope portion 36 increases.

Figure 8C:
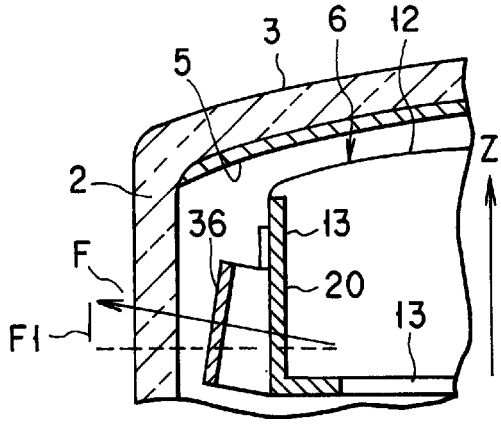
Figure 8B:
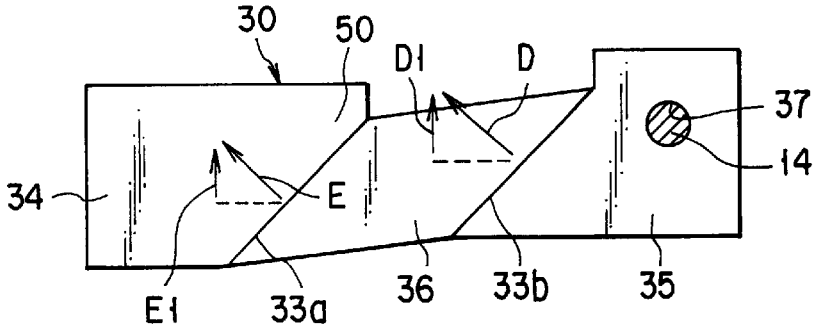
Figure 9:
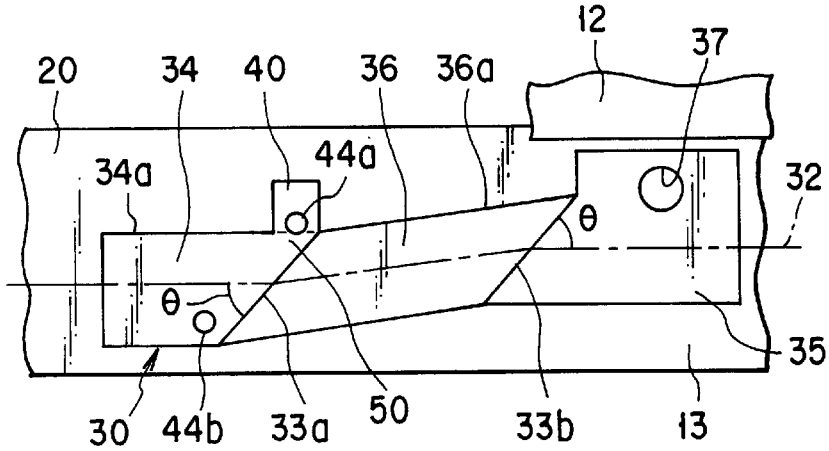
FIG. 9 is a front view illustrating a holder employed in a color cathode-ray tube according to another embodiment of the invention.

In this case, the engagement portion 35 of each holder 30 is fixedly engaged with a corresponding stud pin 14, and therefore the slope portion 36 is displaced in a direction D perpendicular to the second bending line 33*b* with respect to the engagement portion 35, while the fixed portion 34 is displaced in a direction E perpendicular to the first bending line 33*a* with respect to the slope portion 36, as is shown in FIG. 8B. Since the directions D and E contain Z-directional components D1 and E1, respectively, the slope portion 36 and the fixed portion 34 are displaced toward the phosphor screen 5 along the tube axis Z.

Moreover, when the holders 30 are compressed, the slope portions 36 are warped. This warping force causes each slope portion 36 to move in a direction F perpendicular to its surface, as is shown in FIG. 8C. Since each slope portion 36 inclines to the tube axis Z, its F-directional displacement contains a Z-directional component F1. Accordingly, when each slope portion 36 is warped, the fixed portion 34 of the holder is displaced toward the phosphor screen 5 along the tube axis Z.

As a result, the shadow mask 6 supported by the holders 30 is displaced toward the phosphor screen 5 along the tube axis Z, thereby displacing the landing position of each electron beam toward the center of the screen and reducing the degree of the color purity degradation.

To perform the above-described series of correcting operations with high accuracy, any gap must not be provided between the mask frame 13 and that portion of the fixed portion 34 of each holder 30, which is adjacent to the first bending line 33*a*, in particular, between the mask frame and the portion 50 of the fixed portion, which is defined by the first bending line 33*a* and the side edge of the fixed portion that crosses the first bending line at an acute angle. As described above, the fixed portion 34 has the projection 40 which projects from the portion 50 defined by the first bending line 33*a* and the side edge of the fixed portion that crosses the first bending line at an acute angle, and the weld spot 44*a* is provided on the fixed portion 34 including the projection. As a result, a sufficient welding area can be secured, and hence the acute-angle portion 50 of the fixed portion 34 can be welded to the mask frame 13 in a reliable manner, thereby preventing a boundary portion between the fixed portion 34 and the slope portion 36 of each holder 30 from separating from the mask frame 13 and achieving a desired correction effect.

Accordingly, by only changing the shape of the holders which are made of a cheap material, the color cathode-ray tube constructed as above can correct color purity degradation due to thermal expansion, without degrading the elastically supporting property of the holders.

The invention is not limited to the above-described embodiments, but may be modified in various manners without departing from its scope. For example, the number of the weld spots of the fixed portion of each holder is not limited to three, but may be two, or four or more. Further, with the intention of correcting color purity degradation which occurs while the ambient temperature increases, a bimetal may be interposed between the fixed portion of each holder and the mask frame. Although each holder is bent at two portions along two parallel bending lines, it suffices if each holder has at least one bending line, e.g. only the bending line 33*a*.

Although in the embodiments, the projection 40 of the fixed portion 34 extends over the entire longitudinal length of the fixed portion, if the projection 40 is provided only in a position adjacent to the acute-angle portion 50 of the fixed portion 34, the same advantage as that of the embodiments can be obtained.

What is claimed is:

1. A color cathode-ray tube comprising:

a face panel having a substantially rectangular effective section, four side wall sections provided on a peripheral edge portion of the effective section, stud pins provided on inner surfaces of at least three of the side wall sections;

a phosphor screen formed on an inner surface of the effective section of the face panel;

a shadow mask arranged inside the face panel, having a substantially rectangular mask body opposed to the phosphor screen, and also having a substantially rectangular mask frame supporting a peripheral edge portion of the mask body and opposed to the side wall sections;

a plurality of holders elastically supporting the mask frame on the side wall sections of the face panel, for displacing the mask frame toward the phosphor screen along a center axis of the face panel when the mask frame has thermally expanded toward the side wall sections of the face panel; and an electron gun for emitting electron beams toward the phosphor screen through the shadow mask, wherein each of the holders is formed by bending an elongated and substantially rectangular metal plate along at least one bending line which inclines to a longitudinal center axis of the metal plate, such that each of the holders includes an engagement portion engaged with a corresponding one of the stud pins, and a fixed portion fixed to the mask frame, and the fixed portion of each holder has a projection projecting from an acute-angle portion which is defined by a longitudinal side edge of the fixed portion and the bending line, the fixed portion being fixed to the mask frame by welding at least a part of the projection which is in the vicinity of the acute-angle portion, to the mask frame.

2. A color cathode-ray tube according to claim 1, wherein the engagement portion is situated closer to the phosphor screen than the fixed portion with respect to a direction in the center axis of the face panel.

3. A color cathode-ray tube according to claim 1, wherein each of the holders is formed by bending the metal plate along a pair of bending lines which incline to the longitudinal center axis of the metal plate, such that each of the holders has the engagement portion engaged with a corresponding one of the stud pins, the fixed portion fixed to the mask frame, and a slope portion extending and inclined between the engagement portion and the fixed portion, and the pair of bending lines extend parallel to each other, and each of the holders being bent along the pair of bending lines in opposite directions.

4. A color cathode-ray tube according to claim 1, wherein the angle between the bending line and the longitudinal center axis of each of the holders is set smaller than 90°.

5. A color cathode-ray tube according to claim 1, wherein the mask frame has four walls opposed to the side wall sections of the face panel with a predetermined space there between, and each of the holders is attached to a corresponding one of the walls of the mask frame such that the longitudinal center axis of the fixed portion is substantially parallel to a longitudinal center axis of the corresponding wall of the mask frame.

6. A color cathode-ray tube according to claim 1, wherein the mask body has a lower thermal expansion coefficient than the mask frame.

7. A color-cathode-ray tube according to claim 1, wherein each of the holders has a lower thermal expansion coefficient than the mask frame.

8. A color cathode-ray tube according to claim 1, wherein the projection extends over an entire longitudinal length of the fixed portion.

9. A color cathode-ray tube according to claim 1, wherein the projection is formed on in the vicinity of the acute-angle portion.

* * * * *